United States Patent [19]

Hien et al.

[11] Patent Number: 4,724,697

[45] Date of Patent: Feb. 16, 1988

[54] MANDREL ROD HOLDING DEVICE

[75] Inventors: Manfred Hien, Monchen-Gladbach; Heinrich Steinbrecher, Meerbusch, both of Fed. Rep. of Germany

[73] Assignee: Mannesmann AG, Duesseldorf, Fed. Rep. of Germany

[21] Appl. No.: 361,147

[22] Filed: Mar. 24, 1982

[30] Foreign Application Priority Data

Mar. 27, 1981 [DE] Fed. Rep. of Germany ..... 3113119

[51] Int. Cl.[4] ..... B21B 25/02

[52] U.S. Cl. ..... 72/208

[58] Field of Search ..... 72/96, 208, 209, 368, 72/370

[56] References Cited

U.S. PATENT DOCUMENTS 4,311,032 1/1982 Nessi ..... 72/208

4,361,023 11/1982 Blanquet et al. ..... 72/208

*Primary Examiner*—Robert L. Spruill

*Attorney, Agent, or Firm*—Ralf H. Siegemund

[57] ABSTRACT

A combination of a mandrel rod and a mandrel rod holding device for use in a continuous mill for making seamless tubes and being mounted to a driven mandrel rod shifting device, the mandrel rod having a portion of reduced diameter and a shoulder near said end, a two-arm pivot lever is pivoted on the shifting device for pivoting about an axis extending transversely to a direction of extension of the mandrel rod, the direction extending in a direction of rolling; a fork on one arm end of the two-arm pivot lever releasably but form-fittingly holds and engages one end of the mandrel rod and when the two arm pivot lever is in a first pivot position for thereby retarding the mandrel rod as against an action of rolling, the fork engages and retards the shoulder of the mandrel rod, the fork is constructed for releasing the mandrel rod when the two arm pivot lever is in a second pivot position; and a toggle lever has one end pivotally linked to the shifting device and another opposite end is pivotally jointed directly to the other arm end of the two-arm pivot lever, the toggle lever, when in an extended position, causes the two-arm pivot lever to assume a first pivot position thereby maintaining the holding force for the rod, the toggle lever when in a bent position causes the two-arm pivot lever to be in the second pivot position.

9 Claims, 6 Drawing Figures

MANDREL ROD HOLDING DEVICE

BACKGROUND OF THE INVENTION

The present invention relates to a mandrel rod holding device, particularly for continuous rolling mills for the manufacture of seamless pipes by means of rolling in several driven rolling stand, the rolling to occur onto an elongated mandrel which is retarded in a controlled manner during stretching the hollow by means of a mandrel shifting block being releasably connected to the end of the mandrel rod and being movable in the direction of rolling by means of a drive; the mandrel rod is released after the trailing end of the pipe has passed one or several of the stands and will continue to run through the rolling mill in the direction of rolling.

The manufacture of seamless pipes in a continuous rolling mill and in accordance with the method described above is condition on the fact that the mandrel rod with the mandrel is retarded relative to the pipe, at least during a portion of the rolling process. This way it is made possible that the heat resulting from friction work of the mandrel surface is reduced, as compared with a known method, on account of a considerably reduced relative speed between mandrel and pipe. Due to the fact that during the propagation of the front end of the hollow through the first stand the speed of propagation of the mandrel is lower than its working speed, one obtains, however, a relatively large retarding and holding force in the mandrel rod which has to be taken up by the mandrel shifting block.

The known method provides for an increase in through put and for avoiding delays during the retraction of the mandrel rod, in that the mandrel be released after the trailing end of the hollow has entered one of the first frames, i.e., the mandrel is no longer to be held. The mandrel and the mandrel rod will leave the mill in the direction of rolling.

DESCRIPTION OF THE INVENTION

The problem underlying the invention is to be seen in that at first the mandrel rod is to be held back in the mandrel shifting block, and during rolling it is to be released while experiencing rather high holding forces.

It is, therefore, an object of the present invention to provide a mandrel rod holding device which is suitable to safely take up the rather high holding forces as they occur during rolling under utilization of a retarded mandrel and which is also capable to release quickly the mandrel rod while these holding forces are still effective.

For solving the problem, a mandrel rod holding device is suggested in accordance with the present invention which is characterized by a two-arm lever, pivotable on an axis on the mandrel shifting block, the axis running transversely to the direction of rolling so that the two-arm lever pivots in the direction of rolling, one end of the two-arm lever holds the mandrel rod in a formfitting relation when having one particular pivot position, and in the other pivot position the lever releases the mandrel rod, the other end of the two-arm lever is jointed to a toggle lever which in turn is pivotally linked to the mandrel rod shifting block. The toggle lever, when in an extended position, maintains the holding force for the mandrel rod.

First of all, such a toggle lever is in a position to provide extremely high holding forces, and on the other hand, it is suitable to release the mandrel rod being held by means of a lever system, when in the bent position whereby the change of the toggle lever from the extended to the bent position is possible within the least possible period of time. The loading or charging process of a new hollow is not impeded by the bent-back lever, resulting in a reduction of the cycle time.

In accordance with another feature of the invention, the end of the lever holding the mandrel rod is provided in a fork-like configuration, and the fork encloses the mandrel rod in an area ahead of the mandrel rod end and having a reduced cross section whereby the transition of the cross sectional reduction results in a step which can bear against the fork. This way one provides a holder for the mandrel rod which holds the rod securely near its end while being amenable to easy and fast pivoting out of the range of the mandrel rod end because the holder is provided at the end of a retractable lever. In accordance with another feature of the invention, it is suggested that the toggle lever is biased by means of a store for a force (such as a spring) which is relieved when the toggle lever is in its bent position.

This spring has, on the one hand, the function of biasing the toggle lever in the extended position so that lever will not revert unintentionally to the bent position while, on the other hand, the spring will support bending of the elbow lever if such bending is intended. In the first case, the pivot joints of the toggle lever can be arranged so that the benching joint is shifted below the hypothetical connection line between the two outermost joint and to that side which faces away from the bending side of the toggle lever. This way the toggle joint is urged over center as it has to overcome first the dead position in order to be able to bend.

In accordance with another feature of the invention, a force providing means is provided for bending the toggle lever in dependence upon the displacement path of the mandrel shifting block which force providing means acts directly upon the toggle lever. Since the toggle lever is subjected to the holding force of the mandrel and is additionally loaded by the spring, one needs of force which causes bending of the toggle lever in the range of its bending joint. As soon as this force has bent the lever out of its extended position and beyond the dead center, the previously provided force together with the spring force causes a fast folding into the bent end position whereby the fork-shaped lever holding the mandrel rod also folds out of the range of the mandrel rod.

Preferably, the force acts upon the bending joint of the toggle lever transversely to the direction of the holding force as it acts upon the extended toggle lever. In accordance with one embodiment, it is suggested that the toggle lever is extended beyond the pivot point as far as the arm is concerned which is pivotably connected to the mandrel shifting block; moreover, the force causing a moment about the latter pivot point acts upon that extension. This proposal can be realized as far as construction is concerned in a particular favorable manner because the dimensions as far as installation of the mandrel rod holder is concerned will not be increased. One may realize particularly advantageously the extension of the toggle lever when the force for the production of the moment is a two-arm lever which is linked to the mandrel shifting block whereby one end of this two-arm lever is provided with a roll which rolls in the direction of block displacement and is associated with an inclined surface while the other end of this two-arm lever actuates the extended lever arm of the toggle lever.

The roll provided on the one lever arm can roll in a simple manner on a track underneath the mandrel shifting block and underneath the holding device, and upon being deflected by the inclined surface, the roll will cause the pivoting of the lever which in turn results in pivoting the toggle lever which will then quickly advance in the aforementioned manner into the bent position.

In order to return the bent toggle lever to its extended, i.e., tension-biased position, it is suggested in accordance with another feature of the invention to provide a frame acting on the particular lever holding the mandrel rod in the range of the joint as between the latter lever and the toggle lever which frame is slidable relative to the mandrel shifting block while being acted upon by a force in the direction of rolling. Preferably, this frame extends to both sides of the plane of bending of the toggle lever whereby the joint provided between the toggle lever and the lever for holding the mandrel rod is linked and pivoted to that plate.

By means of sliding the proposed frame, one can extend the one particular joint of the toggle lever which is disposed in forward direction as seen in the direction of rolling while the opposite joint is held back so that the toggle lever can, in fact, assume the extended position. Concurrently therewith, the lever holding the mandrel rod is turned anew into the range of the mandrel rod and can, therefore, assume and take up the holding force of the mandrel rod.

Extending the toggle lever can be particularly advantageously attained if, in accordance with a further feature of the invention, one provides the frame with a loading rod extending in the direction opposite the direction of rolling which loading rod can be moved against an appropriate stop upon retraction of the mandrel shifting block. This loading rod is a part of the frame and, in fact, continues the frame parallely to the direction of shifting of the holding device but on the side facing away from the mill. Upon retracting the holding device, the loading rod which is guided on the mandrel shifting block can be urged against a firm stop whereupon the frame slides relative to the mandrel shifting block in the direction of rolling and causes, in effect, the extension of the toggle lever. In this simple manner, one may obtain the tensioning and biasing of the elbow lever automatically upon the retraction of the holding device.

It is of advantage to construct the holding device as a slide or carriage running on guide rails in the direction of rolling, and the toggle lever and the lever for holding the mandrel rod are both pivotally linked to that carriage or slide. However, in accordance with another feature of the invention, it is conceivable that the holding device is directly mounted on a toothed rack of the mandrel shifting drive.

DESCRIPTION OF THE DRAWINGS

An embodiment of the invention is illustrated in the drawings and will be described in the following. Herein is shown in FIG. 1 the mandrel rod holding device in the holding position.

Figure 1:
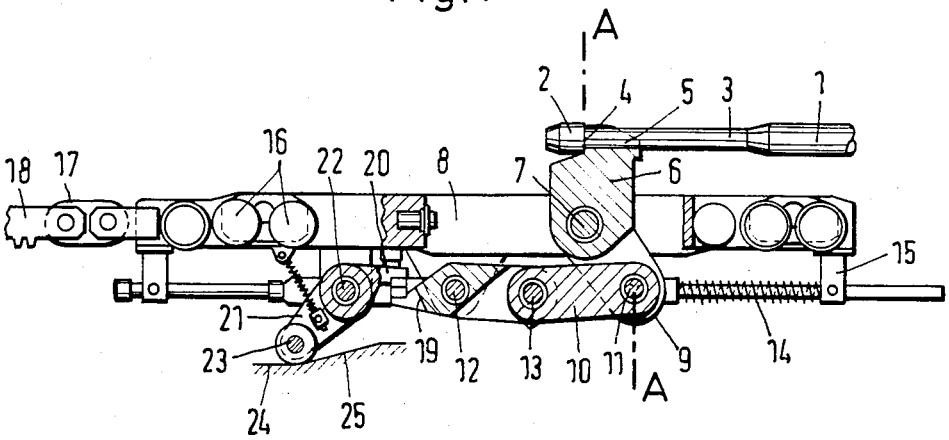

The mandrel rod 1 as shown in FIG. 1 is provided in the range of its rear end with a portion 3 of reduced diameter which ends in a shoulder 4 ahead of the end proper, 2. The fork-shaped end 5 of a lever 6 reaches into this range 3, the lever 6 being pivotally linked at a point 7 to the frame of the mandrel shifting block 8 constructed as a carriage and pertaining to the mandrel rod holding device. The lever 6 has an end 9 facing away from the fork 5 and this end is pivotally linked with a toggle lever 10 which, on the one hand, is linked to the lever 6 at point 11. On the other hand, toggle lever 10 is pivotally linked at the point 12 at a corresponding point of the carriage 8. The bending joint of the toggle lever 10 is designated with reference numeral 13.

As one can see furthermore from FIG. 1, the bending joint 13 of toggle elbow lever is slightly offset in down direction as compared or with reference to the end joints 11 and 12 of the toggle lever whereby a spring 14 causes the toggle lever 10 to be held in the extended but slightly over center position. On the one hand, this spring 14 acts upon a bearing block 15 of the carriage 8 and bears on the other hand on the joint (11) [15] provided between the lever 6 and the toggle lever 10.

The carriage 8 can run on tracks (not shown in this figure) by means of wheels 16 and the carriage 8 is, in addition, connected at point 17 to a toothed rack 18 of the shifting drive.

The toggle lever 10 is physically extended beyond the pivot joint 12 for purposes of forming a lever arm extension 19. A lever arm 20 of another lever 21 acts upon this extension 19, which lever 21 is pivotally linked to the carriage 8 at pivot point 22. The arm of lever 21 extending in the opposite direction as compared to the arm 20 carries a roll 23. This roll runs on a guide track 24 which is inclined in upward direction as shown at 25 and during movement of the carriage 8 the roll 23 runs up the inclined surface 25 and thereby pivots lever 21 about the pivot point 22 such that its lever arm 20 exerts a force upon the toggle lever 10 as extended by the lever arm 19 which force causes a pivoting of the toggle lever about the pivot point 12 to thereupon bending the toggle lever at its bending joint 13. This bending occurs against the holding force of the mandrel rod which force acts at the fork 5 of the lever 6 upon the toggle lever.

Figure 2:
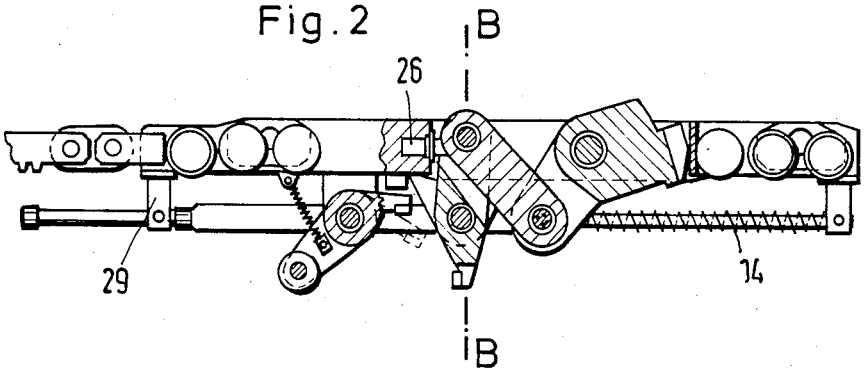
FIG. 2 the mandrel rod holding device in the released position.

As soon as the bending joint 13 of the toggle lever has overcome the dead center point on the (hypothetical) connection line between the joints 11 and 12, the holding force as supported by the force of spring 14 causes a flash-like bending of the toggle lever into position as shown in FIG. 2. Thereupon, force or spring 14 relaxes and the toggle lever rests against the stop 26 in the range of the bending joint 13. This stop 26 can be constructed as an attenuator which diminishes the impact.

Figure 3:
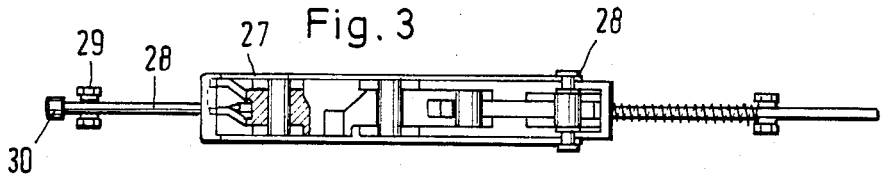
FIG. 3 a section through the toggle lever and the frame.

As can be seen from FIG. 3, a two-part frame 27 extends to both sides of the levers approximately parallel to the displacement track of the carriage 8 which frame 27 is pivotally linked at point 28 with the pivot link 11 of the toggle lever 10. The frame 27 is continued on the side facing away from the rolling mill by means of a loading rod 28 which is held and guided at 29 on the carriage 8 to longitudinal movement. The loading rod 28 has a thick end 30 which thick end can bear against a stationary stop upon displacement of the carriage 8. Upon further movement of the carriage, the loading rod, therefore, has to retract and is displaced relative to the carriage, in the plane of the drawing to the right. This way the frame at 27 is also shifted to the right whereby the frame takes along the joint 11 at point 28 to thereby cause an extension of the toggle lever the other end of which being held at 12. Concurrently thereto, spring 14 is tensioned.

Figure 4:
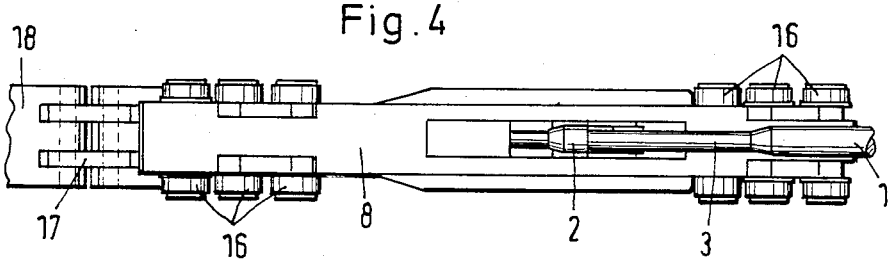
FIG. 4 a top elevation of the mandrel rod holding device as shown in FIG. 1.
Figure 5:
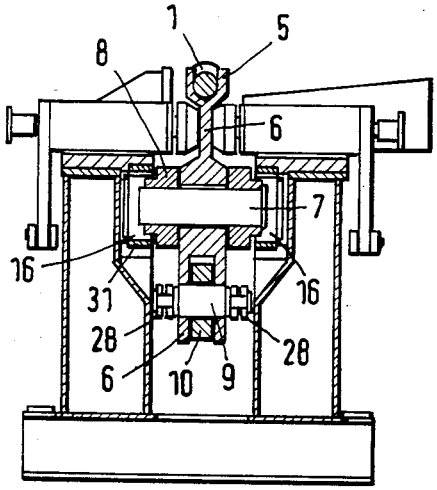
FIG. 5 a section through FIG. 1 taken along the line A—A.
Figure 6:
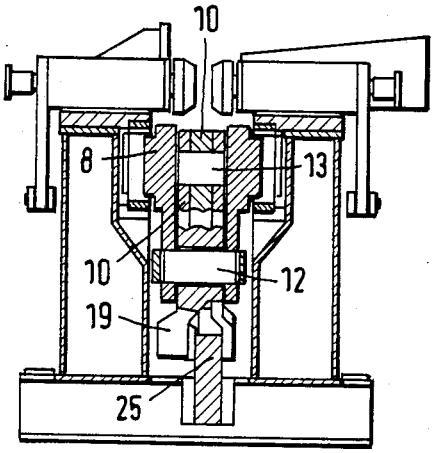
FIG. 6 a section in FIG. 2 taken along the line B—B.

In the FIGS. 4, 5 and 6, similar parts carry like designations. FIG. 4 reveals that the carriage 8 can run on altogether sixteen wheels and the tracks are shown in FIG. 5 and designated by reference numeral 31.

FIG. 6 reveals furthermore that the lever arm 19 of the toggle lever 10 is laterally offset with respect to the running track 25 so that during retraction of the elbow lever, track and lever arm can pass each other.

We claim:

1. A combination of a mandrel rod and a mandrel rod holding device for use in a continuous mill for making seamless tubes and being mounted to a driven mandrel rod shifting device, the mandrel rod having a portion of reduced diameter and a shoulder near said end, comprising:

a two-arm pivot lever pivoted on the shifting device for pivoting about an axis extending transversely to a direction of extension of the mandrel rod, the direction extending in a direction of rolling;

a fork on one arm end of the two-arm pivot lever for releasably but form-fittingly holding and engaging one end of the mandrel rod and when said two arm pivot lever is in a first pivot position for thereby retarding the mandrel rod as against an action of rolling, the fork engaging said shoulder of said mandrel rod for retarding the mandrel rod, the fork being constructed for releasing the mandrel rod when said two arm pivot lever is in a second pivot position; and a toggle lever having one end joint pivotally linked to the shifting device and another opposite end being pivotally jointed directly to the other arm end of the two-arm pivot lever, the toggle lever, when in an extended position, causing the two-arm pivot lever to assume said first pivot position thereby maintaining the holding force for the rod, the toggle lever when in a bent position causing the two-arm pivot lever to be in the second pivot position.

2. A combination of a mandrel rod and of a mandrel rod holding device as in claim 1, including means for biasing the toggle lever into the bent position, the latter means being relieved when the toggle is in the extended position.

3. A combination of a mandrel rod and of a mandrel holding device as in claim 1, including means on the shifting device and provided for acting on the toggle lever in dependence upon the position of the shifting device for actuating the toggle lever towards assuming the bent position.

4. A combination of a mandrel rod and of a mandrel rod holding device as in claim 3, the means for acting, acting upon the toggle lever transversely to the holding force in the extended position of the toggle lever.

5. A combination of a mandrel rod and of a mandrel holding device as in claim 3, the toggle having an extension beyond its one end joint, the means for acting, acting on the extension for obtaining a moment of force about said one end joint.

6. A combination of a mandrel rod and of a mandrel holding device as in claim 5, said means for acting including a two-arm lever pivotally connected to the mandrel rod shifting device, one end of the latter lever holding a roll, another end of the latter lever acting on the extension, there being a stationary cam surface engaging the roll and causing the two-arm lever to be operated in dependence upon the position of the shifting device.

7. A combination of a mandrel rod and a mandrel holding device as in claim 1 including frame means linked to the toggle lever and the two-arm pivot lever at the joint between the two levers, the frame means being coupled to the shifting device.

8. A combination of a mandrel rod and of a mandrel holding device as in claim 7, the frame means carrying a loading rod for pushing the frame into a position to obtain extension of the toggle lever.

9. A combination of a mandrel rod and of a mandrel holding device as in claim 1, the shifting device having wheels.

* * * * *